US009395686B2

(12) United States Patent
Shintani et al.

(10) Patent No.: US 9,395,686 B2
(45) Date of Patent: Jul. 19, 2016

(54) PROCESS CARTRIDGE AND IMAGE FORMING APPARATUS

(71) Applicants: Takeshi Shintani, Kanagawa (JP); Yasuhito Kuboshima, Tokyo (JP); Yusuke Ishizuka, Kanagawa (JP); Kenji Honjoh, Kanagawa (JP); Nobuhiro Kuwabara, Kanagawa (JP)

(72) Inventors: Takeshi Shintani, Kanagawa (JP); Yasuhito Kuboshima, Tokyo (JP); Yusuke Ishizuka, Kanagawa (JP); Kenji Honjoh, Kanagawa (JP); Nobuhiro Kuwabara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/753,697

(22) Filed: Jun. 29, 2015

(65) Prior Publication Data

US 2016/0011562 A1 Jan. 14, 2016

(30) Foreign Application Priority Data

Jul. 11, 2014 (JP) ..... 2014-143076

(51) Int. Cl.
*G03G 15/00* (2006.01)
*G03G 21/00* (2006.01)
*G03G 21/18* (2006.01)

(52) U.S. Cl.
CPC ..... *G03G 21/1814* (2013.01)

(58) Field of Classification Search
CPC ..... G03G 15/553; G03G 21/1814; G03G 21/1652; G03G 21/1817; F16N 15/00
USPC ..... 399/24, 90, 346
See application file for complete search history.

(56) References Cited

U.S. PATENT DOCUMENTS

| | | | | |
|---|---|---|---|---|
| 8,909,122 | B2 * | 12/2014 | Gotoh et al. | F16N 11/08 399/346 |
| 9,068,693 | B2 * | 6/2015 | Hatori et al. | F16N 15/00 |
| 2013/0243449 | A1 | 9/2013 | Hatori et al. | |
| 2013/0251380 | A1 | 9/2013 | Fujimori et al. | |
| 2013/0251381 | A1 | 9/2013 | Seki et al. | |
| 2013/0251382 | A1 | 9/2013 | Honjoh et al. | |
| 2013/0279923 | A1 | 10/2013 | Gotoh et al. | |
| 2014/0037302 | A1 | 2/2014 | Gotoh et al. | |
| 2014/0037303 | A1 | 2/2014 | Tomita et al. | |
| 2014/0037304 | A1 | 2/2014 | Uenishi et al. | |
| 2014/0270881 | A1 | 9/2014 | Gotoh et al. | |
| 2014/0363178 | A1 | 12/2014 | Hatori et al. | |

FOREIGN PATENT DOCUMENTS

| | | |
|---|---|---|
| JP | 2007-187845 | 7/2007 |
| JP | 2014-029408 | 2/2014 |

* cited by examiner

*Primary Examiner* — William J Royer
(74) *Attorney, Agent, or Firm* — Harness, Dickey & Pierce, P.L.C.

(57) ABSTRACT

A process cartridge removably installable in an image forming apparatus includes a cartridge body including an image bearer; a cleaning unit removably attached to the cartridge body and including a lubricant supply device to lubricate the image bearer; a first contact terminal disposed in one of the cleaning unit and the cartridge body; and a second contact terminal disposed in the other of the cleaning unit and the cartridge body. The second contact terminal is disposed to contact the first contact terminal to establish electrical continuity between the cartridge body and the cleaning unit, and an end of the first contact terminal includes a sliding contact portion to slidingly contact the second contact terminal in attachment and removal of the cleaning unit to and from the cartridge body.

20 Claims, 11 Drawing Sheets

PROCESS CARTRIDGE AND IMAGE FORMING APPARATUS

CROSS-REFERENCE TO RELATED APPLICATIONS

This patent application is based on and claims priority pursuant to 35 U.S.C. §119(a) to Japanese Patent Application No. 2014-143076, filed on Jul. 11, 2014, in the Japan Patent Office, the entire disclosure of which is hereby incorporated by reference herein.

BACKGROUND

1. Technical Field

Embodiments of the present invention generally relate to a process cartridge and an image forming apparatus, such as a copier, a printer, a facsimile machine, or a multifunction peripheral or multifunction machine (MFP) having at least two of copying, printing, facsimile transmission, plotting, and scanning capabilities, that include the process cartridge.

2. Description of the Related Art

Typically, image forming apparatuses, such as printers, copiers, facsimile machines, and MFPs having those capabilities, include a photoconductor serving as an image bearer, a charging device to charge a surface of the photoconductor, a developing device to develop a latent image on the photoconductor with a toner image, a cleaning device to clean the photoconductor, and a lubricant supply device to lubricate the surface of the photoconductor. To facilitate maintenance thereof, there are image forming apparatus that use a process cartridge (i.e., a modular unit) in which these components are united so that these components are removed from or installed in the image forming apparatus at a time.

SUMMARY

An embodiment of the present invention provides a process cartridge removably installable in an image forming apparatus.

The process cartridge includes a cartridge body including an image bearer; a cleaning unit removably attached to the cartridge body, the cleaning unit including a lubricant supply device to lubricate the image bearer; a first contact terminal disposed in one of the cleaning unit and the cartridge body; and a second contact terminal disposed in the other of the cleaning unit and the cartridge body. The second contact terminal is disposed to contact the first contact terminal to establish electrical continuity between the cartridge body and the cleaning unit. An end of the first contact terminal includes a sliding contact portion to slidingly contact the second contact terminal in attachment and removal of the cleaning unit to and from the cartridge body.

In another embodiment, an image forming apparatus includes the process cartridge described above.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
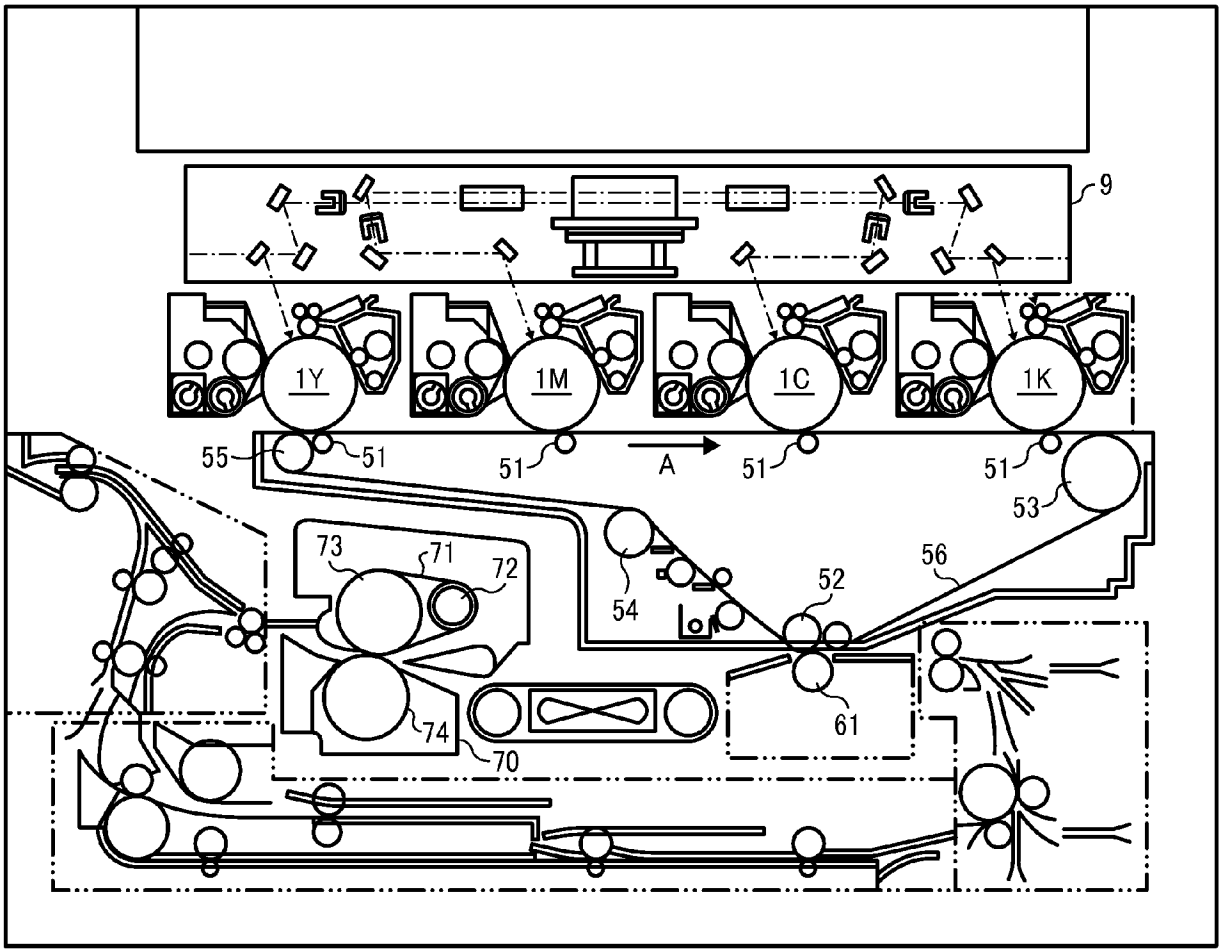
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

Descriptions are given below of an electrophotographic image forming apparatus according to the present embodiment.

FIG. 1 is a schematic view illustrating the image forming apparatus, which in the present embodiment is a printer, for example.

The image forming apparatus includes an intermediate transfer belt 56, serving as an image bearer and an intermediate transfer member, positioned in a substantially center portion inside the image forming apparatus. The intermediate transfer belt 56 is an endless belt made of a heat resistant material such as polyimide and polyamide, and includes a base of medium resistance. The intermediate transfer belt 56 is entrained around four rollers 52, 53, 54, and 55 and rotated in the direction indicated by arrow A in FIG. 1. Above the intermediate transfer belt 56, four image forming units each corresponding to toner of specific color, that is, yellow (Y), magenta (M), cyan (C), or black (K), are disposed side by side along the direction of rotation of the intermediate transfer belt 56.

Figure 2:
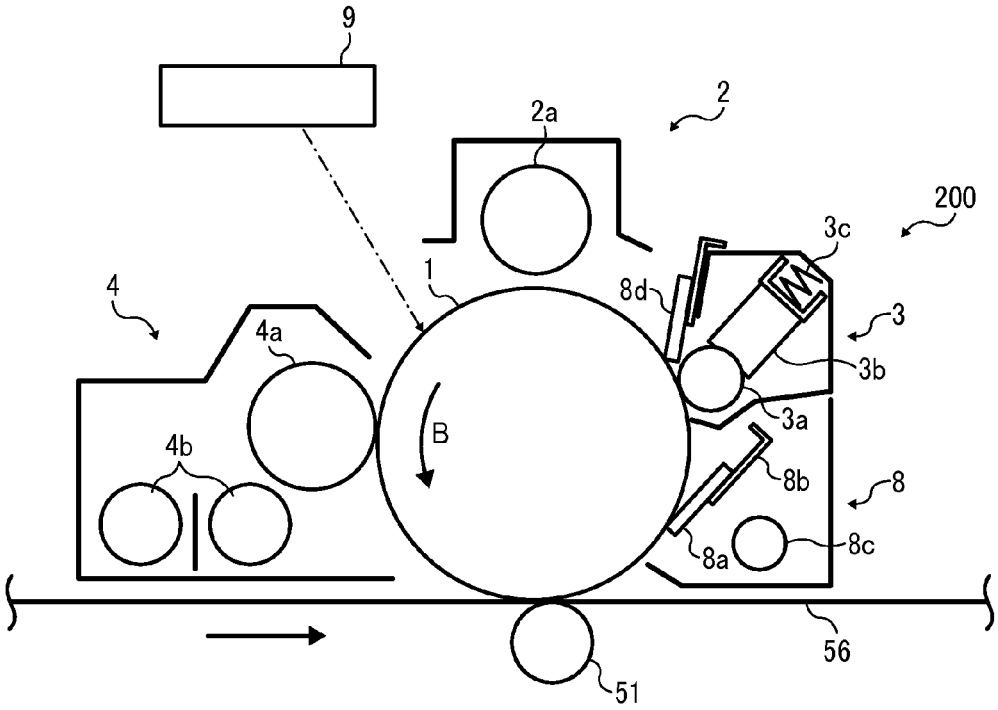
FIG. 2 is a schematic cross-sectional view illustrating a process cartridge of the image forming apparatus illustrated in FIG. 1.

FIG. 2 is a schematic view of one of the four image forming units.

The image forming unit is configured as a process cartridge 200 removably installable in the image forming apparatus. The process cartridges 200 (the image forming units) have a similar configuration, and thus suffixes Y, M, C, and K, each indicating the color of toner used are hereinafter omitted.

Each process cartridge 200 includes an image bearer, which in the present embodiment, is a photoconductor 1. Provided around each photoconductor 1 is a charging device 2 that evenly charges a surface of the photoconductor 1 such that the photoconductor 1 has a desired potential (negative in polarity). Additionally, a developing device 4, a lubricant supply device 3, and a cleaning device 8 are provided around each photoconductor 1. The developing device 4 develops an electrostatic latent image on the surface of the photoconductor 1 with negatively charged toner of each color into a toner image. The lubricant supply device 3 supplies lubricant to the surface of the photoconductor 1, and the cleaning device 8 cleans the surface of the photoconductor 1 after transfer of the toner image therefrom.

The photoconductor 1, the charging device 2, the developing device 4, the cleaning device 8, and the lubricant supply device 3, which are incorporated in the process cartridge 200, are replaceable at a time.

Figure 3:
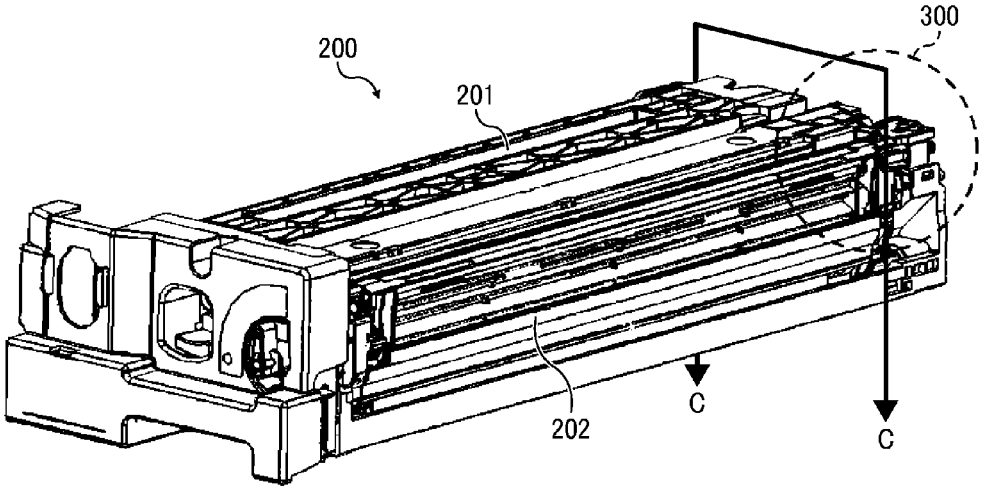
FIG. 3 is a perspective view of the process cartridge illustrated in FIG. 2.

FIG. 3 is a perspective view of the process cartridge 200.

The process cartridge 200 includes a cartridge body 201 and a cleaning unit 202 (i.e., a modular unit) removably attached to the cartridge body 201 (or a casing of the process cartridge 200). In the cleaning unit 202, the cleaning device 8 and the lubricant supply device 3 are united. In this specification, the cartridge body 201 represents a portion of the process cartridge 200 other than the cleaning unit 202. The process cartridge 200 includes a connection section 300 in which contact terminals 202*a* and 202*b* (illustrated in FIGS. 5A and 5B) of the cleaning unit 202 is connected to contact terminals 201*a* and 201*b* (illustrated in FIGS. 5A and 5B) of the cartridge body 201.

Figure 4:
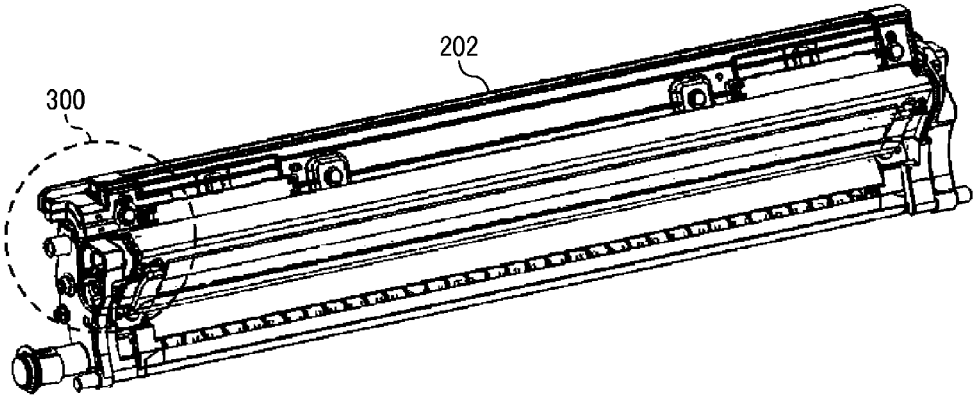
FIG. 4 is a perspective view of a cleaning unit of the process cartridge illustrated in FIG. 3.

FIG. 4 is a perspective view of the cleaning unit 202 removed from the cartridge body 201.

Attachment of the cleaning unit 202 to the cartridge body 201 is described later.

The cleaning unit 202 receives power from the cartridge body 201 and transmits signals from a detector or a sensor to the cartridge body 201. Therefore, a connection portion of the cartridge body 201 includes the contact terminals 201*a* and 201*b*, and the cleaning unit 202 includes the contact terminals 202*a* and 202*b* to contact the contact terminals 201*a* and 201*b* so that electrical continuity is established therebetween. The contact terminals 201*a* and 201*b* may be situated at the casing of the process cartridge 200.

The detection result from a sensor disposed in the cleaning unit 202 is transmitted via the contact terminals 201*a*, 201*b*, 202*a*, and 202*b* to a detection circuitry of the cartridge body 201.

If, for example, powdered lubricant scattering from the lubricant supply device 3 adheres to the contact terminals 202*a* and 202*b* of the cleaning unit 202 or the contact terminals 201*a* and 201*b* of the cartridge body 201 and becomes an insulative coating of such contact terminals, the electrical continuity therebetween is made unstable by the insulative coating. Consequently, the detection result of the sensor of the cleaning unit 202 is not properly transmitted to the cartridge body 201.

According to the present embodiment, electrical continuity is reliably established between the cartridge body 201 and the cleaning unit 202 that includes the lubricant supply device 3 and removably attached to the cartridge body 201.

Returning to FIG. 1, the configuration of the image forming apparatus according to the present embodiment is described below.

An exposure device 9, serving as a latent image forming device, is disposed above the four process cartridges 200 (the image forming units). The exposure device 9 irradiates the charged surface of each photoconductor 1 (1Y, 1M, 1C, and 1K) with light according to image data of the corresponding color, thereby lowering the potential of the irradiated portion, to form an electrostatic latent image on the surface of the photoconductor 1. Additionally, primary transfer rollers 51, serving as primary transfer devices, are disposed facing the respective photoconductors 1 with the intermediate transfer belt 56 interposed therebetween. The primary transfer roller 51 primarily transfers the toner image from the photoconductor 1 onto the intermediate transfer belt 56. The primary transfer roller 51 is connected to a power source, by which a predetermined voltage is applied to the primary transfer roller 51.

A secondary transfer roller 61 serving as a secondary transfer device is pressed against an outer side of a portion of the intermediate transfer belt 56 supported by the roller 52. The secondary transfer roller 61 is connected to a power source, by which a predetermined voltage is applied to the secondary transfer roller 61. A contact portion between the secondary transfer roller 61 and the intermediate transfer belt 56 is called a secondary transfer position (i.e., a secondary transfer nip) where the toner image on the intermediate transfer belt 56 is transferred onto a sheet of recording medium such as transfer paper (i.e., a transfer sheet). A fixing device 70 that fixes the toner image on the transfer sheet is disposed on the left of the secondary transfer position in the drawing. The fixing device 70 includes a heat roller 72, within which a halogen heater is disposed, a fixing roller 73, an endless fixing belt 71 entrained around the heat roller 72 and the fixing roller 73, and a pressing roller 74 opposed to and pressed against the fixing roller 73 with the fixing belt 71 interposed therebetween. A sheet feeder that accommodates and feeds the transfer sheet to the secondary transfer position is disposed in a lower part of the image forming apparatus.

The photoconductor 1 is an organic photoconductor having a protective layer made of polycarbonate resin, for example. The charging device 2 includes a charging roller 2*a*, as a charger, that includes a conductive metal core coated with an elastic layer with medium resistance. It is to be noted that the charger is not limited to roller type but can be a charging brush or a corona discharge-type charger, for example. The charging roller 2*a* is connected to a power source and receives a predetermined voltage therefrom. The charging roller 2*a* and the photoconductor 1 are disposed facing each other across a minute gap. The minute gap can be set, for example, by spacers having a certain thickness and disposed in non-image forming ranges at both ends of the charging roller 2*a* so that each spacer contacts the photoconductor 1.

The developing device 4 includes, as a developer bearer, a developing sleeve 4*a*, opposing to the photoconductor 1. Inside the developing sleeve 4*a*, a magnetic field generator is provided. Beneath the developing sleeve 4*a*, two screws 4*b* are disposed to scoop up developer onto the developing sleeve 4*a* while mixing and agitating the developer with toner supplied from a toner bottle. A layer thickness of developer, which includes toner and magnetic carrier, scooped by the developing sleeve 4*a*, is restricted by a doctor blade so that the developing sleeve 4*a* bears a substantially uniform layer of developer. While rotating in a same direction as the direction of rotation of the photoconductor 1 at a position opposing to the photoconductor 1, the developing sleeve 4*a* transports developer and supplies toner to the electrostatic latent image on the photoconductor 1. It is to be noted that, although FIG. 1 illustrates the developing device 4 employing a two-component development, the embodiment is not limited thereto, but alternatively the developing device 4 may employ a single-component development.

The lubricant supply device 3 includes a solid lubricant 3*b* accommodated within a casing secured at a position, and, as a lubricant applicator, an application roller 3*a* that supplies powdered lubricant scraped off from the solid lubricant 3*b* onto the surface of the photoconductor 1. Examples of the application roller 3*a* include a brush roller, a urethane foam roller, and the like. In a case in which the application roller 3*a* is a brush roller, for example, a preferable brush roller material is produced by adding a resistance control material, such as carbon black, to resin such as nylon, acrylic, and the like, so that the brush roller material has a volume resistivity from $1\times10^3$ Ω·cm to $1\times10^8$ Ω·cm. The application roller 3*a* rotates in a direction counter to the direction of rotation of the photoconductor 1. In other words, the application roller 3*a* rotates in the opposite direction to the direction of rotation of the photoconductor 1 at a position where the application roller 3*a* abuts on or contacts the photoconductor 1.

For example, the solid lubricant 3*b* is shaped rectangular parallelepiped and is pushed to the application roller 3*a* by a pressure spring 3*c* described later. For the solid lubricant 3*b*, lubricant including at least a fatty acid metal salt is used. Examples of the fatty acid metal salt include, but are not limited to, those having lamellar crystallization such as fluorine resin, zinc stearate, calcium stearate, barium stearate, aluminum stearate, and magnesium stearate. Additionally, materials such as lauroyl lysine, monocetyl sodium phosphate, and lauroyltaurine calcium may be used. Of these fatty acid metallic salts, zinc stearate is particularly preferable. This is because zinc stearate spreads well on the surface of the photoconductor 1 and has lower hygroscopicity. Further, zinc stearate keeps high lubricating property even when humidity changes. With these features, a protective layer of lubricant that excels in protecting the photoconductor surface and is less affected by environmental changes can be formed, thereby protecting the surface of the photoconductor 1 preferably. Additionally, since the lubricating property thereof is not easily degraded, it is effective in inhibiting defective cleaning. Alternatively, to the fatty acid metal salts described above, liquid materials such as silicone oil, fluorine oil, and natural wax, or gaseous materials may be added externally.

It is also preferable that the lubricant of the solid lubricant 3*b* include boron nitride that is an inorganic lubricant. Examples crystalline structures of boron nitride include, but are not limited to, a low-pressure phase hexagonal system (h-BN) and a high-pressure phase cubic system (c-BN). Of these, low-pressure phase hexagonal boron nitride has a layered structure and is easily cleaved Accordingly, low coefficient of friction at about 0.2 or lower can be kept up to around 400 C.°, and characteristics are less affected by electrical discharge. Therefore, compared with other types of lubricant, lubricating property is less likely to deteriorate even with an electrical discharge. Addition of such boron nitride prevents the thin layer of lubricant supplied to the surface of the photoconductor 1 from quickly deteriorating due to electrical discharge generated while the charging device 2 or the primary transfer rollers 51 operates. Characteristics of boron nitride are not easily changed by electrical discharge and thus the lubricating property of boron nitride is not lost by electrical discharge compared with other types of lubricant. Further, boron nitride prevents a photoconductive layer of the photoconductor 1 from being oxidized and volatilized by the electrical discharge. Additionally, even if the amount added is small, boron nitride exhibit a good lubricating property, and it is effective in preventing chatter of a cleaning blade 8*a* as well as problems caused by lubricant adhering to the charging roller 2*a* or the like.

In the present embodiment, a lubricant material including zinc stearate and boron nitride is compressed into the solid lubricant 3*b*. It is to be noted that a method of forming the solid lubricant 3*b* is not limited to thereto, but other methods such as a melt process may be used. Thus, the effects of both zinc stearate and boron nitride can be attained.

Although the solid lubricant 3*b* is consumed by being scraped off by the application roller 3*a* and thus a thickness (or height) of the solid lubricant 3*b* is reduced over time, the pressure spring 3*c* constantly presses the solid lubricant 3*b* to abut on or contact the application roller 3*a*. The application roller 3*a* supplies the lubricant scraped off from the solid lubricant 3*b* to the surface of the photoconductor 1 while rotating. Thereafter, the lubricant supplied is spread and leveled into a thin lubricant layer by the contact between the cleaning blade 8*a* and the surface of the photoconductor 1. As a result, the friction coefficient on the surface of the photoconductor 1 is reduced. It is to be noted that, since the layer of lubricant adhering to the surface of the photoconductor 1 is very thin, charging of the photoconductor 1 by the charging roller 2*a* is not hindered.

The cleaning device 8 includes, as a cleaner, the cleaning blade 8*a*, a support 8*b*, and a toner collection coil 8*c*. For example, the cleaning blade 8*a* includes a rubber plate made of urethane rubber, silicone rubber, or the like, and disposed so that one edge thereof contacts or abuts the surface of the photoconductor 1 to remove residual toner from the surface of the photoconductor 1 after transfer of the toner image from the photoconductor 1. The cleaning blade 8*a* is attached or bonded to and supported by the support 8*b* made of metal, plastics, ceramics, and the like, or combination thereof, and is disposed at a certain angle relative to the photoconductor 1. It is to be noted that the cleaner is not limited to a cleaning blade but may be a known configuration such as a cleaning brush.

In the cleaning unit 202, the lubricant supply device 3 is disposed downstream from the cleaning device 8 in the direction indicated by arrow B in FIG. 2, in which the photoconductor 1 rotates. Subsequently, as a leveling blade 8*d* slidingly contacts the surface of the photoconductor 1, the lubricant applied to the surface of the photoconductor 1 by the lubricant supply device 3 is spread over the surface of the photoconductor 1, and thus application unevenness can be roughly leveled.

A description is now given of a detailed configuration of the lubricant supply device 3.

Figure 5A:
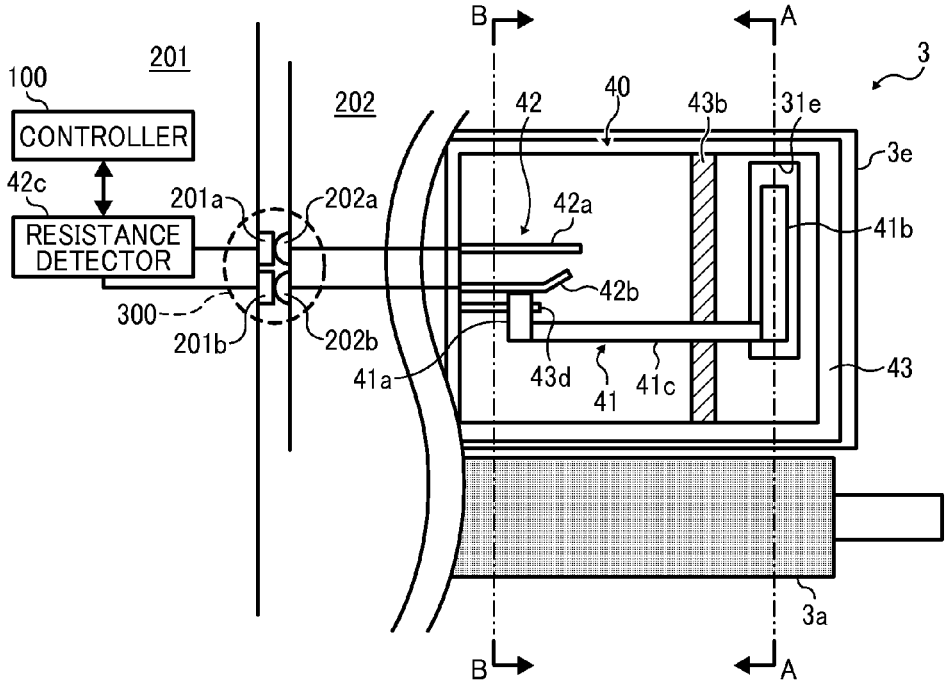
FIGS. 5A and 5B are schematic views illustrating a longitudinal end portion of a lubricant supply device of the cleaning unit illustrated in FIG. 4.
Figure 5B:
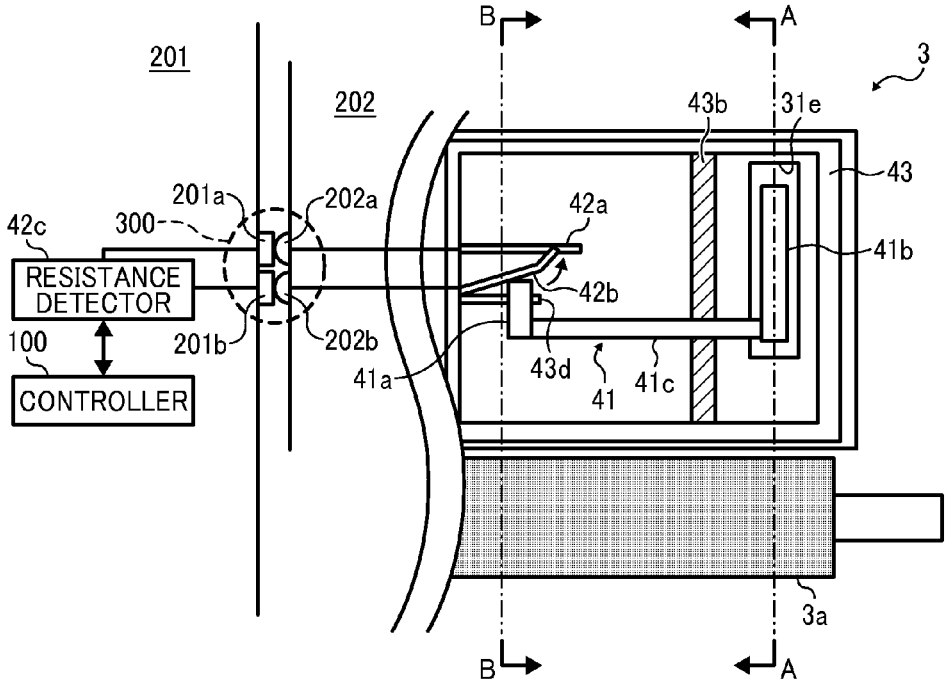
Figure 6A:
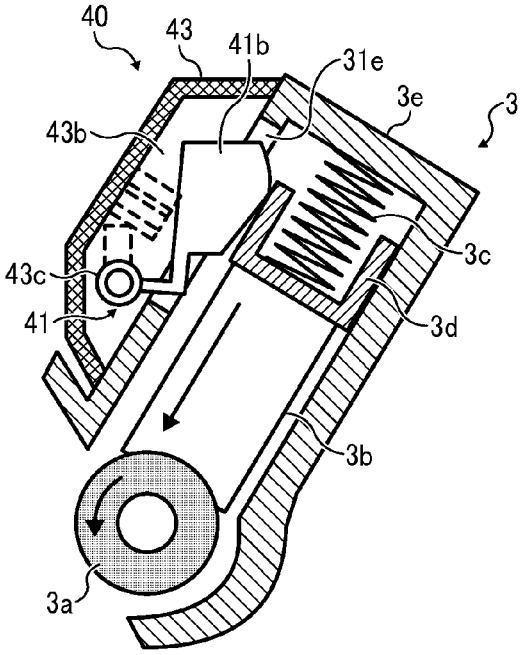
FIGS. 6A and 6B are cross-sectional views along line A-A in FIGS. 5A and 5B.
Figure 6B:
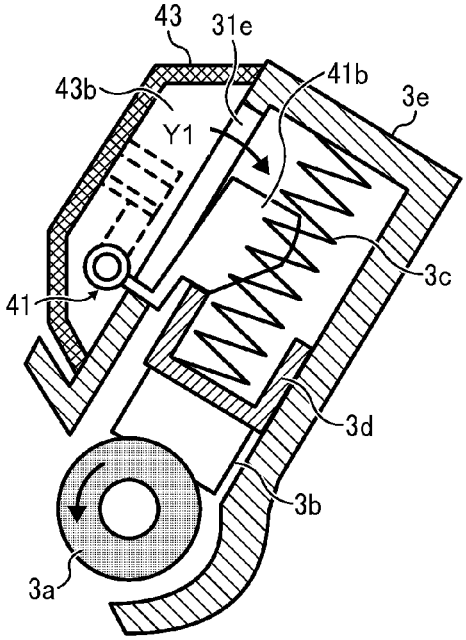

FIGS. 5A and 5B are schematic views illustrating a longitudinal end portion of the lubricant supply device 3 in the cleaning unit 202. FIGS. 6A and 6B are cross-sectional views along line A-A in FIGS. 5A and 5B, and FIGS. 7A and 7B are cross-sectional views along line B-B in FIGS. 5A and 5B.

Figure 7A:
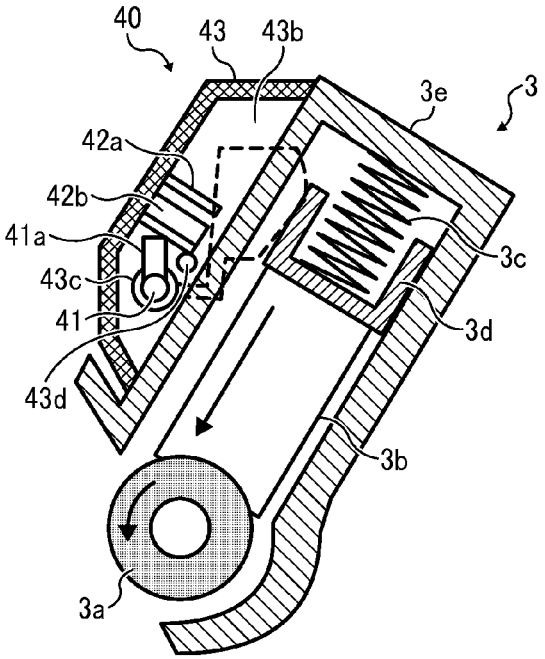
FIGS. 7A and 7B are cross-sectional views along line B-B in FIGS. 5A and 5B.
Figure 7B:
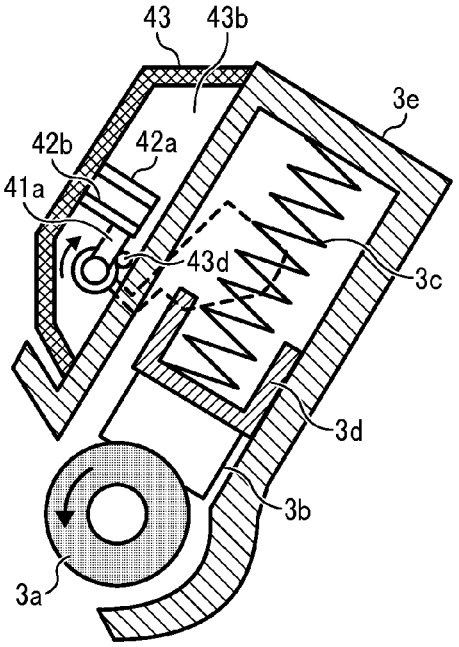

FIGS. 5A, 6A, and 7A schematically illustrate an early stage of use of the solid lubricant 3*b*. FIGS. 5B, 6B, and 7B schematically illustrate a state in which the amount of the solid lubricant 3*b* remaining is small (near-end stage).

It is to be noted that the other longitudinal end portion of the lubricant supply device 3 is similar in configuration to the end portion shown in those drawings.

As illustrated in FIGS. 6A, 6B, 7A, and 7B, the lubricant supply device 3 further includes a lubricant holder 3*d* that holds, over the longitudinal direction of the solid lubricant 3*b*, a face of the solid lubricant 3*b* opposite a face (lower face in the drawings) that contacts the application roller 3*a*. The lubricant holder 3*d* is disposed within a casing 3*e* to contact and be disengaged from the application roller 3*a*. The pressure spring 3*c*, which presses the solid lubricant 3*b* against the application roller 3*a*, is disposed in a space above the lubricant holder 3*d* within the casing 3*e*. The solid lubricant 3*b* is pressed against the application roller 3*a* by the pressure spring 3*c*.

Additionally, a lubricant amount detector 40, serving as the lubricant detector, is disposed near both ends of the solid lubricant 3*b* in the longitudinal direction of the solid lubricant 3*b*. As illustrated in FIGS. 6A through 7B, the lubricant amount detector 40 is disposed on a lateral face of the casing 3*e* and positioned above the lubricant holder 3*d*. As illustrated in FIGS. 5A and 5B, the lubricant amount detector 40 includes a rotator 41 and a rotation detector 42 to detect rotation of the rotator 41.

The rotation detector 42 includes a first electrode 42*a*, a second electrode 42*b* opposed to the first electrode 42*a*, a resistance detector 42*c*, and the like. The resistance detector 42*c* is located at the cartridge body 201. The resistance detector 42*c* is connectable to the first electrode 42*a* and the second electrode 42*b* via contact terminals 201*a* and 201*b* of the cartridge body 201 and contact terminals 202*a* and 202*b* of the cleaning unit 202. The resistance detector 42*c* applies voltage between the first and second electrodes 42*a* and 42*b* and measure an electrical resistance therebetween. Additionally, the resistance detector 42*c* is electrically connected to a controller 100, which determines a replacement timing of lubricant according to a detection result generated by the resistance detector 42*c*. The lubricant amount detector 40 further includes a cover 43 to cover the rotator 41 and the first and second electrodes 42*a* and 42*b*. The rotator 41 and the first and second electrodes 42*a* and 42*b* are positioned and supported by the cover 43.

Each of the first and second electrodes 42*a* and 42*b* is planar and constructed of a conductive material such as sheet metal, and the right end (end in the longitudinal direction of the solid lubricant) of the second electrode 42*b* in the drawing is held by the cover 43 to be able to deform toward the first electrode 42*a*. Additionally, the right end of the second electrode 42*b* in the drawing is bent toward the first electrode 42*a*.

Additionally, an opening 31*e* extending in a direction of movement of the lubricant holder 3*d* is present in the lateral face of the casing 3*e* positioned downstream from the contact position where the application roller 3*a* contacts or abuts the solid lubricant 3*b*, in the direction of rotation of the application roller 3*a*. In the present embodiment, the rotator 41 includes a shaft portion 41*c* extending in the longitudinal direction of the solid lubricant 3*b* within the cover 43 and includes a contact part 41*b* that penetrates the opening 31*e* and contacts the lubricant holder 3*d*. The contact part 41*b* is positioned at a first end (right end in FIGS. 5A and 5B, on the longitudinal end side of the lubricant supply device 3) of the shaft portion 41*c* of the rotator 41. To a second end of the shaft portion of the rotator 41, a detected portion 41*a* is provided. The detected portion 41*a* pushes the second electrode 42*b* to cause the second electrode 42*b* to abut against the first electrode 42*a*, thereby detecting that the rotator 41 has rotated.

As illustrated in FIGS. 6A and 6B, the contact part 41*b* extends from the shaft portion 41*c* of the rotator 41 toward the opening 31*e* and includes a planar portion perpendicular to the longitudinal direction of the solid lubricant 3*b*. With the contact part 41*b* having above-described structure, the rotator 41 rotates clockwise in the drawing under the gravity as indicated by arrow Y1 in FIG. 6B. Additionally, in the present embodiment, the lubricant supply device 3 is inclined clockwise relative to the vertical direction in FIGS. 6A through 7B. Accordingly, with the lubricant amount detector 40 is provided to the lateral face of the casing 3*e* and situated above the lubricant holder 3*d*, the contact part 41*b* can abut against the lubricant holder 3*d* as the rotator 41 rotates under the gravity.

Additionally, the cover 43 includes a partition wall 43*b* that divides an internal space encompassed by the cover 43 into two parts, that is, a first part within which the opening 31*e* is situated and a second part within which the first and second electrodes 42*a* and 42*b* are disposed. As illustrated in FIGS. 5A and 5B, the rotator 41 penetrates a through-hole 43*c* in the partition wall 43*b*. Then, the first end of the rotator 41 including the contact part 41*b* is positioned in the first part including the opening 31*e*. The second end of the rotator 41 including the detected portion 41*a* is positioned in the second part in which the first and second electrodes 42*a* and 42*b* are provided.

Additionally, a rotation restrictor 43*d* to restrict the rotation of the rotator 41 is provided to a side wall of the cover 43. The rotation restrictor 43*d* extends from the side wall (on the left in FIGS. 5A and 5B) of the cover 43 on the center side in the longitudinal direction of the lubricant supply device 3 to the rotator 41. As illustrated in FIG. 7A, an end of the rotation restrictor 43*d* faces the detected portion 41*a* across a predetermined gap.

As illustrated in FIG. 6A, in the early stage of use, the contact part 41*b* of the rotator 41 contacts or abuts the lubricant holder 3*d*, thereby inhibiting the rotation of the rotator 41 under the gravity. At that time, as illustrated in FIGS. 5A and 7A, the detected portion 41*a* of the rotator 41 does not push the second electrode 42*b*, and the second electrode 42*b* is disengaged from the first electrode 42*a*. Accordingly, no electric current flows between the first and second electrodes 42*a* and 42*b* even if voltage is applied between the first and second electrodes 42*a* and 42*b* with the resistance detector 42*c*. Thus, measurement of electrical resistance value is not available.

As the solid lubricant 3*b* is gradually scraped and reduced in height due to consumption of lubricant, the lubricant holder 3*d* approaches the application roller 3*a*. When the solid lubricant 3*b* is reduced to or below a predetermined height (near-end stage), the contact part 41*b* is disengaged from a side face (parallel to the longitudinal direction of the lubricant supply device 3) of the lubricant holder 3*d* as illustrated in FIG. 6B. Then, the rotator 41 rotates under the gravity in the direction indicated by arrow Y1 in FIG. 6B, and the detected portion 41*a* pushes in the second electrode 42*b* as illustrated in FIG. 7B. With this movement, the second electrode 42*b* deforms to the first electrode 42*a*, and the end (right side end in FIG. 5B) of the second electrode 42*b* contacts the first electrode 42*a* as illustrated in FIG. 5B. As the second electrode 42*b* thus contacts the first electrode 42*a*, electrical continuity is established between the first and second electrodes 42*a* and 42*b*. Then, application of voltage between the first and second electrodes 42*a* and 42*b* by the resistance detector 42*c* generates an electric current between the first and second electrodes 42*a* and 42*b*. As a result, the resistance detector 42*c* measures an electrical resistance value, and the controller 100 recognizes that the solid lubricant 3*b* is in the near-end stage and the rotator 41 has rotated.

The controller 100 monitors the readings taken by the resistance detector 42*c*. Detecting that the electrical resistance value measured by the resistance detector 42*c* is at or less than a threshold value, the controller 100 determines that the solid lubricant 3*b* reaches the near-end stage. Then, the controller 100 reports that the solid lubricant 3*b* is almost used up to a user and prompts the user to replacement of the solid lubricant 3*b*. Additionally, the controller 100 may report the necessity of replacement of lubricant to a service center, using a communication tool.

In the present embodiment, the electrical continuity between the first and second electrodes 42*a* and 42*b* is not established until the solid lubricant 3*b* enters the near-end stage, and electrical current does not flow even when voltage is applied between the electrodes. As a result, electric power is not wasted each time the near-end stage is the detection, thereby reducing power consumption. In addition, the rotation detector 42 can be constructed of the first and second electrodes 42*a* and 42*b* made of a relatively inexpensive material such as sheet metal. Thus, the rotation detector 42 can be inexpensive.

Additionally, the lubricant amount detector 40 is disposed near each end of the solid lubricant 3*b* in the longitudinal direction in the present embodiment. Therefore, even when the consumption of the solid lubricant 3*b* is different in the longitudinal direction, upon reaching the near-end stage at one end on a greater consumption side, the rotator 41 disposed on the greater consumption side rotates. Then, the second electrode 42*b* contacts the first electrode 42*a* to establish electrical continuity therebetween. With this configuration, even when the solid lubricant 3*b* is consumed at different rates in the longitudinal direction, the near-end stage of lubricant can be accurately detected. This configuration can prevent, for example, an inconvenience that the lubricant is used up on the side on which the consumption is greater and the photoconductor 1 is not protected, resulting in damage to the photoconductor 1.

Further, in the present embodiment, since the lubricant amount detector 40 is disposed outside the casing 3*e*, adherence of scattered powdered lubricant to the first and second electrodes 42*a* and 42*b* is inhibited.

Additionally, although the contact part 41*b* is caused to contact the lubricant holder 3*d*, alternatively, the contact part 41*b* may be designed to contact the solid lubricant 3*b*. The solid lubricant 3*b*, however, is fragile and easily crumbles, and there is a risk that the solid lubricant 3*b* crumbles or cracks due to sliding contact with the contact part 41*b* when the contact part 41*d* contacts the solid lubricant 3*b*. For this reason, it is preferable that the contact part 41*b* contacts the lubricant holder 3*d* to reduce the above-mentioned risk.

Additionally, in the lubricant amount detector 40 according to the present embodiment, the contact part 41*b* at the first end of the rotator 41 extending in the longitudinal direction of the solid lubricant 3*b* contacts the lubricant holder 3*d*, the detected portion 41*a* is provided to the second end of the rotator 41, and the near-end stage of lubricant is detected by detecting, with the rotation detector 42, the rotation of the detected portion 41*a*. With this configuration, as illustrated in FIG. 5A, a detecting portion (the contact portion between the first electrode 42*a* and the second electrode 42*b*) to detect the near-end stage of lubricant can be positioned away from the opening 31*e*. This configuration can inhibit the powdered lubricant scraped off by the application roller 3*a* from adhering to the contact portion of the first electrode 42*a* with the second electrode 42*b* or the contact portion of the second electrode 42*b* with the first electrode 42*a*. This configuration can inhibit the occurrence of poor continuity caused by lubricant adhering to the first and second electrodes 42*a* and 42*b*, and the near-end stage of lubricant can be detected with a preferable accuracy.

Additionally, compared with the configuration in which the rotator 41 extends in the short side direction, extending the rotator 41 in the longitudinal direction of the solid lubricant 3*b* can reduce the space necessary to keep the second end (detected portion 41*a*) of the rotator 41 a predetermined distance away from the opening 31*e*.

Additionally, in the present embodiment, the partition wall 43*b* divides the internal space encompassed by the cover 43 into the space in which the opening 31*e* is situated and the space within which the first and second electrodes 42*a* and 42*b* are disposed. This configuration can further inhibit the powdered lubricant entering the internal space via the opening 31*e* from adhering to the first and second electrodes 42*a* and 42*b*. It is to be noted that the partition wall 43*b* can be provided to either the cover 43 or the casing 3*e*. Further alternatively, a partition wall may be provided to each of the cover 43 and the casing 3*e* so that, when the two partition walls are combined together, the internal space encompassed by the cover 43 is divided into the first part, in which the opening 31*e* is situated, and the second part, within which the first and second electrodes 42*a* and 42*b* are disposed.

Additionally, in the present embodiment, the opening 31*e* and the first and second electrodes 42*a* and 42*b* are covered with the cover 43. Accordingly, powdered lubricant can be inhibited from scattering outside the lubricant supply device 3 via the opening 31*e*, thereby inhibiting contamination of the apparatus. In addition, adherence of the scattered toner to the first and second electrodes 42*a* and 42*b* can be inhibited, thereby inhibiting defective electrical continuity between the first and second electrodes 42*a* and 42*b*.

Additionally, in the present embodiment, the rotator 41 rotates under its own weight. Accordingly, it is not necessary to use another component, such as a spring, to bias the rotator 41 to rotate clockwise in FIGS. 6A and 6B so that the contact part 41*b* is urged toward the lubricant holder 3*d* when the contact part 41*b* is disengaged from the side face of the lubricant holder 3*d*. With this configuration, the number of components can be reduced, thereby making the device inexpensive.

Additionally, in the present embodiment, the cover 43 holds the first and second electrodes 42*a* and 42*b* and the rotator 41 and determines the positions thereof. Component tolerances can be minimized when an identical component holds the first and second electrodes 42*a* and 42*b* and the rotator 41 and determines the positions thereof. Accordingly, the first and second electrodes 42*a* and 42*b* and the rotator 41 are accurately positioned relative to one another. With this configuration, when the solid lubricant 3*b* is in the near-end stage, the second electrode 42*b* can reliably contacts the first electrode 42*a*, and the near-end stage can be detected with a higher degree of accuracy.

Additionally, in the lubricant amount detector 40, since the second electrode 42*b* is deformed to contact the first electrode 42*a*, there is a risk that the initial shape of the second electrode 42*b* is changed over time. Additionally, there is a risk that contact between the first and second electrodes 42*a* and 42*b* causes corrosion, smear, or substances adhering thereto, resulting in erroneous detection. Consequently, there arises a necessity of replacement of the lubricant amount detector 40. In the present embodiment, since the cover 43 holds the first and second electrodes 42*a* and 42*b* and the rotator 41 and determines the positions thereof, the lubricant amount detector 40 can be easily detached from the lubricant supply device 3 by simply removing the cover 43 from the casing 3*e*. Thus, replacement of the lubricant amount detector 40 is facilitated.

Additionally, in the present embodiment, the state detected is not a state immediately before the lubricant is used up (so-called the end of lubricant) but the near-end stage, meaning that a slight amount of lubricant remains, and the surface of the photoconductor 1 can be lubricated for predetermined number of sequences of image formation. In a case in which the end of lubricant is detected, image formation must be prohibited until replacement of lubricant is completed in order to inhibit inconveniences caused by exhaustion of lubricant. Thus, downtime is caused.

By contrast, the near-end stage of lubricant is detected in the present embodiment. Accordingly, after the near-end stage is detected, lubricant can be still supplied to the surface of the photoconductor 1 for the predetermined number of sequences of image formation, thereby protecting the surface of the photoconductor 1. As a result, image formation is feasible in a preparation period of lubricant after the detection of near-end stage until replacement is started. Thus, the occurrence of downtime is suppressed. Additionally, if the number of sequences of image formation reaches or exceeds the predetermined number during the preparation, the lubricant is used up, causing the inconveniences. Accordingly, when the near-end stage is detected, the distance traveled (the number of rotation) by the application roller 3*a*, the number of sequences of image formation performed, or the like is monitored. When the distance traveled by the application roller 3*a*, the number of sequences of image formation performed, or the like reaches a predetermined threshold, it is determined that the lubricant is at the end thereof, and image formation is prohibited.

The amount of the lubricant supplied to the photoconductor 1 is not constant but varies depending on an area ratio of an image formed on the surface of the photoconductor 1 or the like. Specifically, when the toner image is transferred onto the intermediate transfer belt 56 from the lubricated surface of the photoconductor 1 at the primary transfer position, lubricant may be also transferred onto the intermediate transfer belt 56 together with the toner image from the surface of the photoconductor 1. Thus, compared with an image with a lower area ratio, an image with a higher area ratio makes the amount of lubricant on the photoconductor 1 smaller. As a result, when the image area ratio is higher, a larger amount of lubricant is supplied to the surface of the photoconductor 1. For these reasons, consumption of the solid lubricant 3*b* differs between users who frequently output images having a lower area ratio such as letters and users who frequently output images having a higher area ratio such as photographs. Therefore, unlike the present embodiment, if the near-end stage is determined only by an operating time of the image forming apparatus, such as the distance traveled by the application roller 3*a*, accurate detection of the near-end stage under all usage conditions is not possible. For example, in a case where the near-end stage is determined by the distance traveled by the application roller 3*a* under a usage condition to consume a larger amount of lubricant, replacement of lubricant that is not yet used up may be instructed under a usage condition to consume a smaller amount of lubricant. Conversely, in a case where the near-end stage is determined by the distance traveled by the application roller 3*a* for the usage condition to consume a less amount of lubricant, lubricant may be used up before the near-end stage is detected under the usage condition to consume a larger amount of lubricant.

By contrast, when the near-end stage of the solid lubricant 3*b* is detected by the lubricant amount detector 40 based on the height of the solid lubricant 3*b* as in the present embodiment, the near-end stage of lubricant is more accurately detected, regardless of usage conditions, compared with the configuration in which the distance traveled by the application roller 3*a* is used for determining the near-end stage.

Additionally, in the present embodiment, the rotation restrictor 43*d* is provided to restrict excessive rotation of the rotator 41. In a case where the rotation restrictor 43*d* is not provided, differently from the present embodiment, when the lubricant amount detector 40 is replaced, it is possible that the rotator 41 rotates excessively, and the contact part 41*b* is positioned lower. If the lubricant amount detector 40 is attached to the lubricant supply device 3 in which the contact part 41*b* is positioned lower, the lubricant amount detector 40 fails to accurately detect the near-end stage of lubricant. Accordingly, in attaching the lubricant amount detector 40 to the side face of the casing 3*e*, it is necessary to check that the contact part 41*b* is at an upper position and contacts the lubricant holder 3*d* properly. Thus, replacement workability is reduced. Additionally, in replacement, there is a risk that the second electrode 42*b* is excessively pushed by the detected portion 41*a* to the first electrode 42*a*, causing a risk of plastic deformation of the first electrode 42*a* and the second electrode 42*b*. If the first electrode 42*a* is plastically deformed, it is possible that the second electrode 42*b* fails to contact the first electrode 42*a* even if the solid lubricant enters the near-end stage and the detected portion 41*a* deforms the second electrode 42*b* into a predetermined shape. Then, the near-end stage is not detected. Additionally, when the second electrode 42*b* deforms plastically, it is possible that, although the detected portion 41*a* does not push the second electrode 42*b*, the second electrode 42*b* contacts the first electrode 42*a*, and the detection of near-end stage is not feasible.

By contrast, in the present embodiment, the rotation restrictor 43*d* is provided. Accordingly, in replacement of the lubricant amount detector 40, even if the rotator 41 is about to excessively rotate clockwise in FIGS. 6A through 7B, the detected portion 41*a* contacts the rotation restrictor 43*d*. Then, rotation of the rotator 41 is restricted. With this configuration, in replacement of the lubricant amount detector 40, the contact part 41*b* is reliably at the upper position. Therefore, even if an operator or worker does not check the position of the contact part 41*b* during the replacement of the lubricant amount detector 40, the contact part 41*b* can be properly disposed to contact the lubricant holder 3*d*. Consequently, replacement of the lubricant amount detector 40 is facilitated. Additionally, limiting the rotation of the rotator 41 with the rotation restrictor 43*d* can inhibit the second electrode 42*b* from being pushed to the first electrode 42*a* excessively. This configuration can inhibit plastic deformation of the first electrode 42*a* and the second electrode 42*b*.

Additionally, depending on the apparatus structure, the rotator 41 may not sufficiently extend in the longitudinal direction of the solid lubricant 3*b*, and there may be no space to provide the partition wall 43*b*. In this case, there is the risk that the powdered lubricant scattering from the opening 31*e* of the casing 3*e* adheres to the first and second electrodes 42*a* and 42*b*. In particular, under the usage condition in which images having lower image area ratios are output frequently, out of powdered lubricant, the lubricant that is not supplied to the photoconductor 1 accumulates on the casing 3*e*. Consequently, a part of the lubricant accumulating on the casing 3*e* passes through the opening 31*e*, and the amount of lubricant adhering to the first or second electrode 42*a* or 42*b* increases. As a result, poor continuity occurs between the first and second electrodes 42*a* and 42*b*, thus increasing the risk that the near-end stage of lubricant is not detected. As a result, there is a risk that the solid lubricant is used up and the surface of the photoconductor is not protected with the lubricant. In view of the foregoing, in another embodiment, the near-end stage of lubricant is detected based on both the distance traveled by the application roller 3*a* and the establishment of electrical continuity between first and second electrodes 42*a* and 42*b*.

Figure 8A:
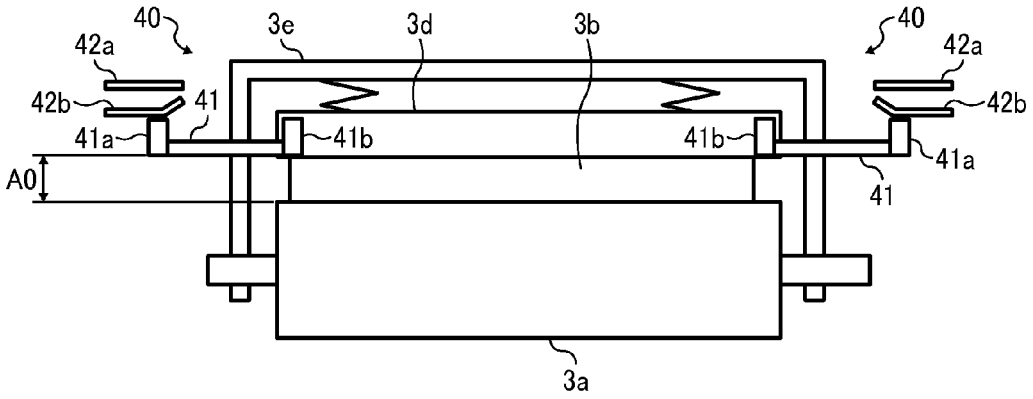
FIG. 8A is a side view of a solid supply device holding a solid lubricant being at the initial stage of use.
Figure 8B:
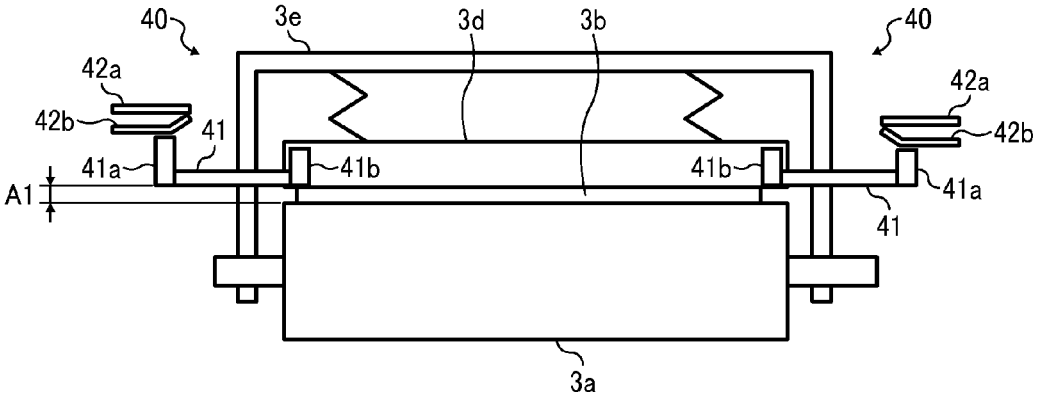
FIG. 8B is a side view of the solid supply device holding a solid lubricant being at a near-end stage.
Figure 8C:
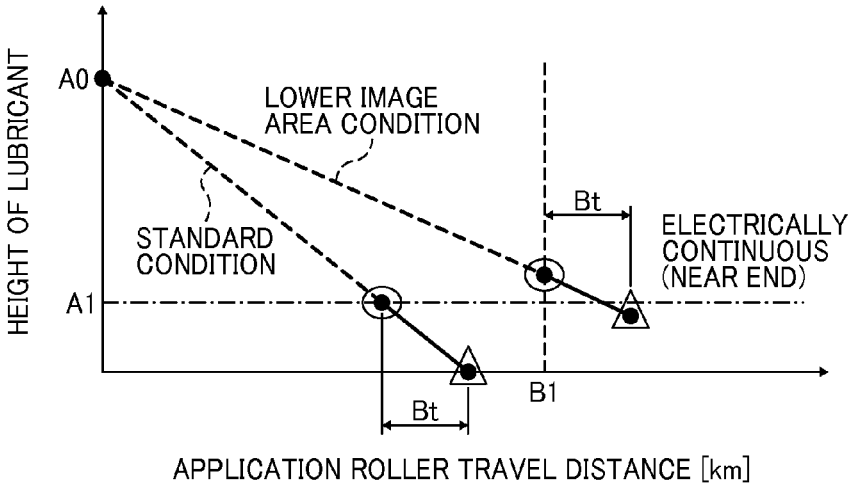
FIG. 8C is a graph illustrating a relation between a travel distance of an application roller and a height of the solid lubricant of the solid supply device illustrated in FIGS. 8A and 8B.

Referring to FIGS. 8A, 8B, and 8C, descriptions are given below of changes in the amount of the solid lubricant 3*b* and a timing to detect the near-end stage.

FIG. 8A is a side view of the solid lubricant 3*b* having a height A0, being at the initial stage of use. FIG. 8B is a side view of the solid lubricant 3*b* having a height A1, being at near-end stage. FIG. 8C is a graph illustrating a relation between the travel distance of the application roller 3*a* and the height of the solid lubricant 3*b*.

As illustrated in FIG. 8C, under a standard condition, the first and second electrodes 42*a* and 42*b* becomes electrically continuity before the distance traveled by the application roller 3*a* reaches a threshold B1, and the near-end stage is detected. In FIG. 8C, if the application roller 3*a* travels for an amount Bt after the detection of the near-end stage, the height of the solid lubricant 3*b* is reduced to zero before the distance traveled by the application roller 3*a* reaches the threshold B1. Then, it is determined that the lubricant is at the end of use. Then, image formation is prohibited.

By contrast, under the usage condition in which images with a lower area ratio are frequently formed (i.e., a lower image area condition), the distance traveled by the application roller 3*a* reaches the threshold B1 before the height of the solid lubricant fall to the height A1 and electrical continuity is established between the first and second electrodes 42*a* and 42*b*. When the application roller 3*a* travels further for the amount Bt from the threshold B1, the near-end stage of lubricant is detected.

As described above, in the case where images with a lower area ratio are often formed and there is the risk that the near-end stage is not detected based on the electrical continuity, the near-end stage is detected using the distance traveled by the application roller 3*a*. This configuration inhibits an inconvenience that the lubricant amount detector 40 fails to detect the near-end stage and the use is continued. With this configuration, the surface of the photoconductor 1 is reliably protected with lubricant.

Not limited to the distance traveled by the application roller 3*a*, the near-end stage of lubricant may be detected by measuring a rotation time of the application roller 3*a*. Further, in a configuration including the rotatable application roller 3*a* and capable of changing the rotation speed (rotation number) of the lubricant application roller 3*a*, for example, depending on environmental fluctuations, measurement of the distance traveled thereby can increase the accuracy in detecting the near-end stage.

Although, in the description above, the threshold B1 is set to the distance traveled by the application roller 3*a* when the solid lubricant 3*b* reaches the near-end stage under the usage condition in which images with a lower area ratio are frequently formed, the threshold B1 is not limited thereto. For example, in a case where the process cartridge includes a component that ends its product life before the lubricant reaches the near-end stage under the usage condition in which images with a lower area ratio are frequently formed, as the threshold B1 may be set to the distance traveled by the application roller 3*a* at which that component ends its product life.

Additionally, the lubricant amount detector 40 of the present embodiment can be used to detect whether the solid lubricant is property set. Specifically, in the case of the lubricant amount detector 40 according to the present embodiment, the contact part 41*b* is contactless with the lubricant holder 3*d* when the solid lubricant 3*b* is not set properly or the solid lubricant 3*b* is not set. Accordingly, in those cases, the detected portion 41*a* pushes the second electrode 42*b*, and the first electrode 42*a* is in contact with the first electrode 42*a*. Therefore, when the solid lubricant 3*b* is not set properly or the solid lubricant 3*b* is not set, the resistance detector 42*c* detects the electrical continuity. Therefore, when the process cartridge or the lubricant supply device 3 is replaced, whether or not the solid lubricant 3*b* is set can be detected by checking the electrical continuity using the resistance detector 42*c*.

Attachment of the cleaning unit 202 to the cartridge body 201 is described below.

Figure 9A:
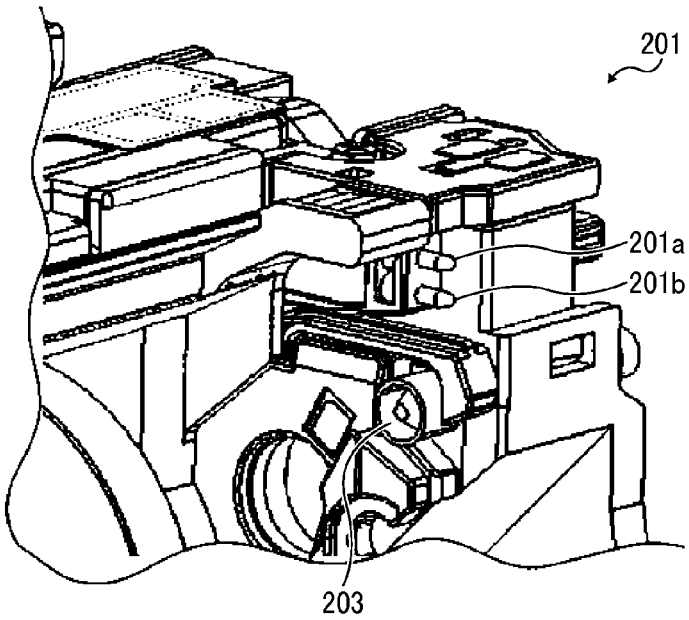
FIG. 9A is an enlarged view of a connection portion of the process cartridge according to an embodiment.

FIG. 9A is an enlarged view of the connection portion of the cartridge body 201 connected to the cleaning unit 202. The cartridge body 201 includes the contact terminals 201*a* and 201*b* connected to the resistance detector 42*c*, and a positioning pin 203 to position the cleaning unit 202 attached to the cartridge body 201.

Figure 9B:
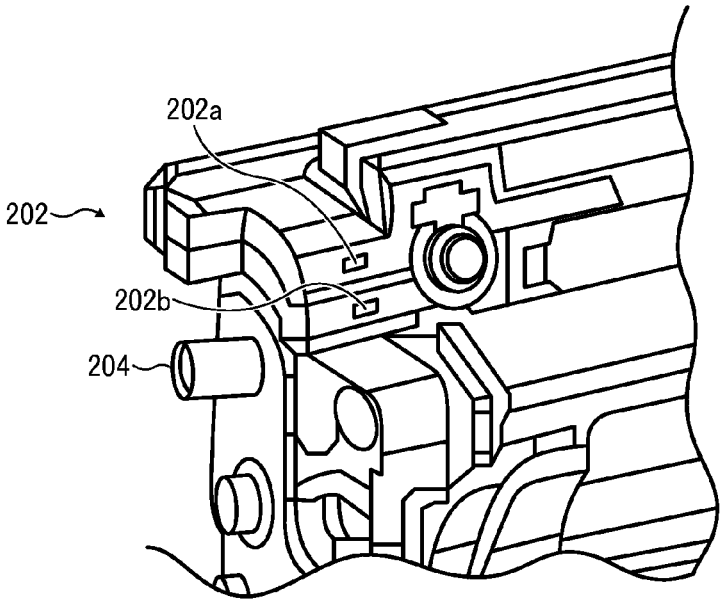
FIG. 9B is an enlarged view of a connection portion of the cleaning unit connected to the process cartridge illustrated in FIG. 9A.

FIG. 9B is an enlarged view of the connection portion of the cleaning unit 202 connected to the cartridge body 201. The cleaning unit 202 includes the contact terminals 202*a* and 202*b* leading to the second electrode 42*b*, and a positioning hole 204.

Figure 10:
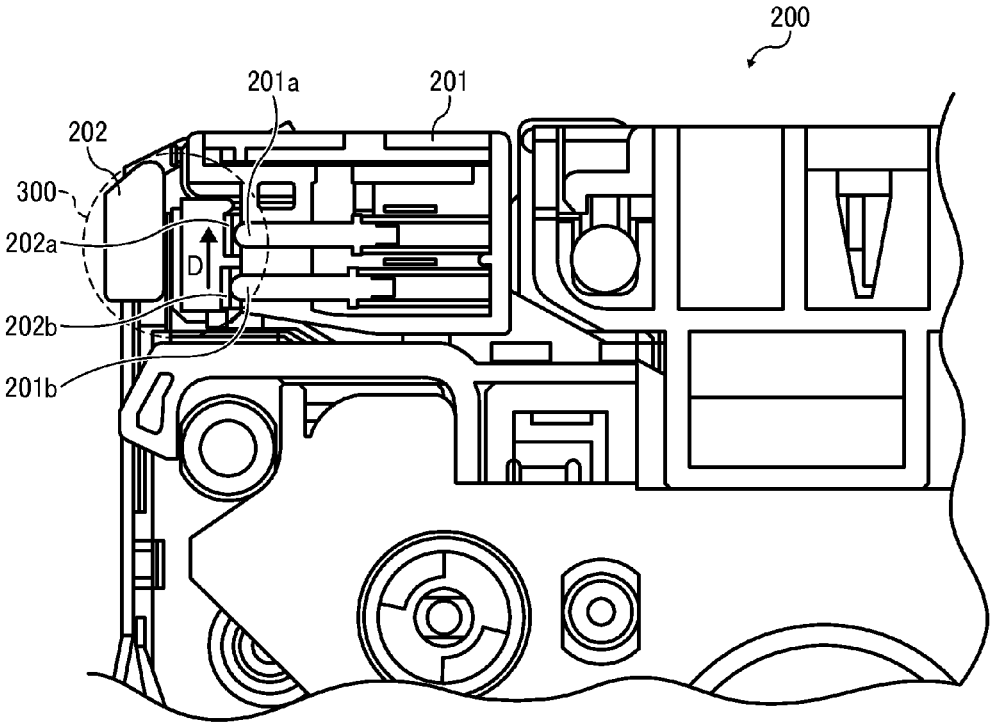
FIG. 10 is a cross-sectional view of the process cartridge along line C-C in FIG. 3.

FIG. 10 is a cross-sectional view along line C-C in FIG. 3, which is the perspective view of the process cartridge 200.

When the cleaning unit 202 is attached to the cartridge body 201, in the connection section 300, the contact terminal 201*a* slidingly contacts the contact terminal 202*a*, and the contact terminal 201*b* slidingly contacts the contact terminal 202*b*. To remove the cleaning unit 202 from the cartridge body 201, the cleaning unit 202 is moved in the direction indicated by arrow D in FIG. 10.

Figure 11A:
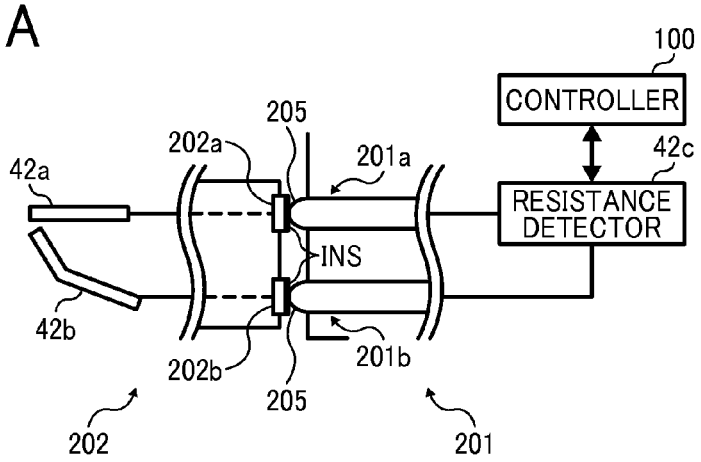
FIGS. 11A and 11B are enlarged views of contact terminals of the process cartridge illustrated in FIG. 10A and contact terminals of the cleaning unit illustrated in FIG. 10B.
Figure 11B:
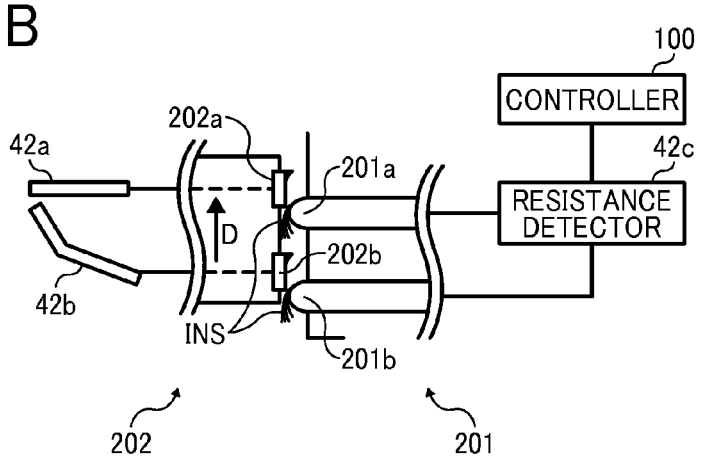

Referring to FIGS. 11A and 11B, descriptions are given below of action of the contact terminals 201*a*, 201*b*, 202*a*, and 202*b* in removal of the cleaning unit 202 from the cartridge body 201.

In a state in which the cleaning unit 202 is in the cartridge body 201 as illustrated in FIG. 11A, the contact terminal 201*a* is pressed to the contact terminal 202*a*, and the contact terminal 201*b* is pressed to the contact terminal 202*b*. Each of the contact terminals 201*a* and 201*b* of the cartridge body 201 includes a curved end face 205, serving as a sliding contact portion to slidingly contact the contact terminal 202*a* or 202*b*. The curved end face 205 has a small curvature. For example, the end of each of the contact terminals 201*a* and 201*b* is curved outward and shaped like a bullet.

As described above, it is possible that the contact terminals 201*a*, 201*b*, 202*a*, and 202*b* are coated with powdered lubricant scattering from the lubricant supply device 3 and insulated, resulting in unstable electrical continuity therebetween.

The contact portions of the contact terminals 201*a* and 201*b*, which slidingly contact the contact terminal 202*a* or 202*b*, are designed to remove such insulation coatings (given reference "INS" in FIGS. 11A and 11B).

When the cleaning unit 202 is moved in the direction indicated by arrow D to remove the cleaning unit 202 from the cartridge body 201, the curved end faces 205 of the contact terminals 201*a* and 201*b* slidingly contact the contact terminals 202*a* and 202*b* of the cleaning unit 202 and scrape off insulation coatings INS adhering to the surface of the contact terminals 202*a* and 202*b*. Then, the electrical continuity between the lubricant amount detector 40 and the resistance detector 42*c* can become stable.

It is to be noted that, the contact terminal to which the sliding contact portion to slidingly contact a counterpart contact terminal is not limited to the contact terminals of the cartridge body 201. In another embodiment, the sliding contact portion to slidingly contact is provided to the contact terminals of the cleaning unit 202. In yet another embodiment, the sliding contact portion to slidingly contact is provided to the contact terminals of both of the cartridge body 201 and the cleaning unit 202.

[Variation]

A first variation of the contact terminals 201*a* and 201*b* of the cartridge body 201 is described below.

Figure 12:
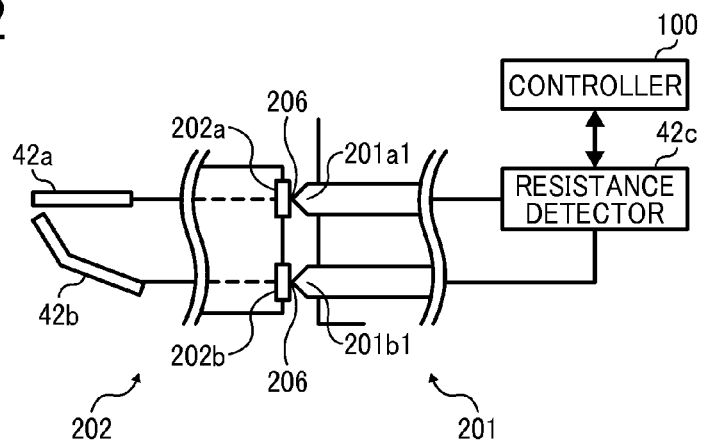
FIG. 12 is an enlarged view of contact terminals of a process cartridge and contact terminals of a cleaning unit according to a variation.

FIG. 12 illustrates contact terminals 201*a*1 and 201*b*1 having an angular end.

Specifically, each of the contact terminals 201*a*1 and 201*b*1 includes an angular projection 206 (a corner) at an end thereof. Compared with the configuration illustrated in FIGS. 11A and 11B, in which each of the contact terminals 201*a* and 201*b* has the curved end face 205 with a small curvature, the angular projection 206 has an enhanced capability to remove the insulation coating INS.

Figure 13:
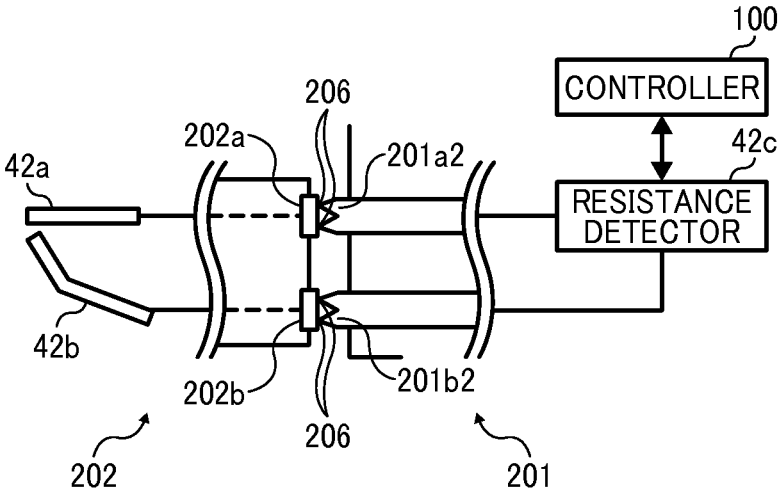
FIG. 13 is an enlarged view of contact terminals of a process cartridge and contact terminals of a cleaning unit according to another variation.

FIG. 13 illustrates contact terminals 201*a*2 and 201*b*2 having multiple angular projections 206 at their ends.

The configuration illustrated in FIG. 13 is advantageous over the configuration illustrated in FIG. 12 in that the capability to remove the insulation coating INS is enhanced and the number of points of contact with the counterpart contact terminal (202*a* or 202*b*) is increased, thereby reducing the risk of poor continuity between the contact terminals.

Figure 14:
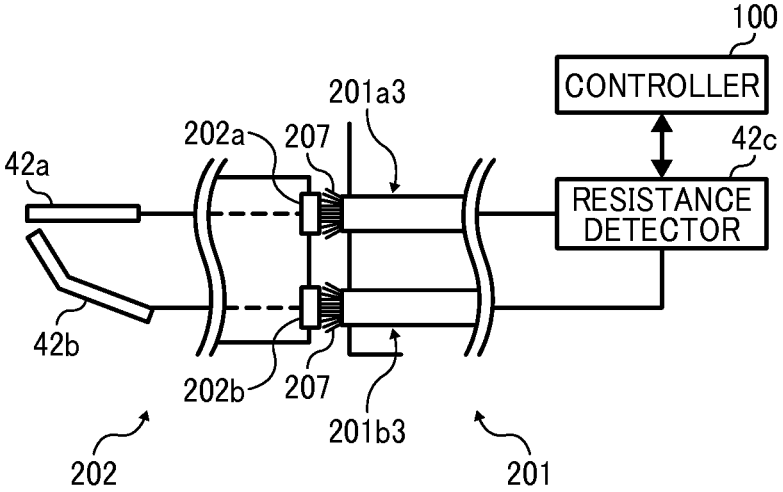
FIG. 14 is an enlarged view of contact terminals of a process cartridge and contact terminals of a cleaning unit according to another variation.

FIG. 14 illustrates contact terminals 201*a*3 and 201*b*3 having a metal brush 207 at their ends.

The configuration illustrated in FIG. 14 is advantageous over the configuration illustrated in FIG. 13 in that the capability to remove the insulation coating INS is enhanced and the number of points of contact with the counterpart contact terminal (202*a* or 202*b*) is increased, thereby reducing the risk of poor continuity between the contact terminals.

The configurations described above are just examples, and each of the following aspects of this specification attains a specific effect.

Aspect A: Aspect A concerns a process cartridge that includes a cartridge body (i.e., a cartridge casing) including an image bearer; and a modular unit (such as the cleaning unit 202) including a lubricant supply device to lubricate the image bearer. The modular unit is removably attached to the cartridge body. The process cartridge includes a first contact terminal (i.e., the contact terminals 201*a* and 201*b*) disposed in one of the modular unit and the cartridge body and a second contact terminal disposed in the other. The second contact terminal contacts the first contact terminal (i.e., the contact terminals 202*a* and 202*b*) to establish electrical continuity between the cartridge body and the modular unit. The first contact terminal is configured to exert friction force on the second contact terminal to remove an insulation coating from the second contact terminal while the modular unit is attached to or removed from the cartridge body.

Specifically, the first contact terminal includes a curved end face having a small curvature, shaped like a bullet. When the modular unit is attached to or removed from the cartridge body, the curved end face of the first contact terminal contacts the second contact terminal and removes the insulation coating from the second contact terminal by exerting friction force on the second contact terminal. Then, the electrical continuity between the first and second contact terminals can be stabilized.

Aspect B: In Aspect A, the modular unit includes a lubricant detector, such as the lubricant amount detector 40, to detect the amount of lubricant in the lubricant supply device, and the cartridge body includes a detector, such as the resistance detector 42*c*, to receive data from the lubricant detector. In this configuration, the first contact terminal establishes electrical continuity between the lubricant detector and the detection circuitry.

In the contact terminal for electrical continuity, the curved end face of the first contact terminal contacts the second contact terminal and removes the insulation coating from the second contact terminal by exerting friction force on the second contact terminal. Then, the electrical continuity between the lubricant amount detector 40 and the resistance detector 42*c* can become stable, thereby inhibiting erroneous detection of the amount of lubricant remaining.

Aspect C: In Aspect A, the first contact terminal is for power supply to the modular unit or grounding of the modular unit.

In the contact terminal for power supply to the modular unit or grounding of the modular unit, the curved end face of the contact terminal contacts the counterpart contact terminal and removes the insulation coating from the counterpart contact terminal by exerting friction force on the counterpart contact terminal. This configuration can stabilize the power supply to the modular unit or the grounding of the modular unit, thereby inhibiting malfunction of the modular unit.

Aspect D: In any of Aspects A through C, the first contact terminal includes at least one angular projection.

When the modular unit is attached to or removed from the cartridge body, the angular projection (or angular projections) of the first contact terminal contacts the second contact terminal and removes the insulation coating from the second contact terminal by exerting friction force on the second contact terminal. Then, the electrical continuity between the first and second contact terminals can be stabilized.

Aspect E: In Aspect D, the first contact terminal has a surface roughness Rz equal to or greater than 300.

The end of the first contact terminal having the surface roughness Rz equal to or greater than 300 contacts the second contact terminal and exerts friction force on the second contact terminal. Then, the insulation coating, which can result in poor continuity between the contact terminals, is removed from the second contact terminal. Then, the electrical continuity between the first and second contact terminals can be stabilized.

Aspect F: The process cartridge according to any one of Aspects A through E is removably installable in an image forming apparatus to form an image on a recording medium.

This configuration can stabilize the electrical continuity between the cartridge body and the modular unit such as the cleaning unit 202.

Numerous additional modifications and variations are possible in light of the above teachings. It is therefore to be understood that, within the scope of the appended claims, the disclosure of this patent specification may be practiced otherwise than as specifically described herein.

What is claimed is:

1. A process cartridge removably installable in an image forming apparatus, the process cartridge comprising:

a cartridge body including an image bearer;

a cleaning unit removably attached to the cartridge body, the cleaning unit including a lubricant supply device configured to lubricate the image bearer;

a first contact terminal in one of the cleaning unit and the cartridge body; and a second contact terminal in the other of the cleaning unit and the cartridge body, the second contact terminal configured to contact the first contact terminal to establish electrical continuity between the cartridge body and the cleaning unit, wherein an end of the first contact terminal includes a sliding contact portion configured to slidingly contact the second contact terminal in attachment and removal of the cleaning unit to and from the cartridge body.

2. The process cartridge according to claim 1, wherein the cleaning unit comprises a lubricant detector configured to detect a lubricant in the lubricant supply device, the cartridge body includes a detector configured to receive data from the lubricant detector, and the first contact terminal is configured to establish electrical continuity between the lubricant detector of the cleaning unit and the detector of the cartridge body.

3. The process cartridge according to claim 1, wherein the sliding contact portion of the first contact terminal is a curved face projecting outward.

4. The process cartridge according to claim 3, wherein the curved face is bullet-shaped.

5. The process cartridge according to claim 1, wherein the sliding contact portion of the first contact terminal comprises at least one angular projection.

6. The process cartridge according to claim 1, wherein the sliding contact portion of the first contact terminal has a surface roughness Rz equal to or greater than 300.

7. An image forming apparatus comprising the process cartridge according to claim 1.

8. A process cartridge removably installable in an image forming apparatus, the process cartridge comprising:

a cartridge body including an image bearer:

a cleaning unit removably attached to the cartridge body, the cleaning unit including a lubricant supply device configured to lubricate the image bearer;

a first contact terminal in one of the cleaning unit and the cartridge body; and a second contact terminal in the other of the cleaning unit and the cartridge body, the second contact terminal configured to contact the first contact terminal to establish electrical continuity between the cartridge body and the cleaning unit, wherein the first contact terminal and the second contact terminal face each other in a direction intersecting with an attachment direction in which the cleaning unit is attached to the cartridge body, and wherein the first contact terminal tapers toward the second contact terminal.

9. The process cartridge according to claim 8, wherein the cleaning unit comprises a lubricant detector configured to detect a lubricant in the lubricant supply device, the cartridge body includes a detector configured to receive data from the lubricant detector, and the first contact terminal is configured to establish electrical continuity between the lubricant detector of the cleaning unit and the detector of the cartridge body.

10. The process cartridge according to claim 8, wherein the first contact terminal includes a sliding contact portion and the sliding contact portion of the first contact terminal is a curved face projecting outward.

11. The process cartridge according to claim 10, wherein the curved face is bullet-shaped.

12. The process cartridge according to claim 8, wherein the first contact terminal includes a sliding contact portion and the sliding contact portion of the first contact terminal comprises at least one angular projection.

13. The process cartridge according to claim 8, wherein the first contact terminal includes a sliding contact portion and the sliding contact portion of the first contact terminal has a surface roughness Rz equal to or greater than 300.

14. An image forming apparatus comprising the process cartridge according to claim 8.

15. A process cartridge removably installable in an image forming apparatus, the process cartridge comprising:

a cartridge body;

a removable device removably attached to the cartridge body, the removable device including a lubricant supply device configured to lubricate a lubricant target;

a first contact terminal in one of the removable device and the cartridge body; and a second contact terminal in the other of the removable device and the cartridge body, the second contact terminal configured to contact the first contact terminal to establish electrical continuity between the cartridge body and the removable device, wherein an end of the first contact terminal includes a sliding contact portion configured to slidably contact and attach to and detach from the second contact terminal.

16. The process cartridge according to claim 15, wherein the cartridge body includes an image bearer, and the removable device includes a cleaning unit configured to clean the image bearer.

17. The process cartridge according to claim 15, wherein the removable device comprises a lubricant detector configured to detect a lubricant in the lubricant supply device, the cartridge body includes a detector configured to receive data from the lubricant detector, and the first contact terminal is configured to establish electrical continuity between the lubricant detector of the removable device and the detector of the cartridge body.

18. The process cartridge according to claim 15, wherein the sliding contact portion of the first contact terminal is a curved face projecting outward.

19. The process cartridge according to claim 15, wherein the sliding contact portion of the first contact terminal has a surface roughness Rz equal to or greater than 300.

20. An image forming apparatus comprising the process cartridge according to claim 15.

* * * * *